US006409103B1

(12) United States Patent
Norville et al.

(10) Patent No.: US 6,409,103 B1
(45) Date of Patent: Jun. 25, 2002

(54) 360° ROTATIONAL DIRECTIONAL NOZZLE FOR TRIGGER SPRAYERS

(75) Inventors: John M. Norville, Madison, WI (US); James B. Caldwell, Sherman Oaks, CA (US)

(73) Assignee: 360 Enterprises, Sherman Oaks, CA (US)

( * ) Notice: Subject to any disclaimer, the term of this patent is extended or adjusted under 35 U.S.C. 154(b) by 0 days.

(21) Appl. No.: 09/695,686

(22) Filed: Oct. 24, 2000

(51) Int. Cl.[7] ..... B05B 15/08; B67D 5/40

(52) U.S. Cl. ..... 239/587.1; 239/587.2; 239/587.3; 239/587.4; 239/587.5; 239/587.6; 222/383.3

(58) Field of Search ..... 239/587.1, 587.2, 239/587.3, 587.4, 587.5, 587.6, 333, 375, 378; 222/383.1, 383.3, 533, 536, 526

(56) References Cited

U.S. PATENT DOCUMENTS

| | | | | | |
|---|---|---|---|---|---|
| 923,277 | A | | 6/1909 | Klinger | |
| 2,759,766 | A | * | 8/1956 | Thomas | 239/587.2 |
| 2,884,206 | A | * | 4/1959 | Dukes | 239/587.1 |
| 3,061,202 | A | * | 10/1962 | Tyler | 239/333 |
| 4,035,004 | A | | 7/1977 | Hengesbach | 285/166 |
| 4,800,913 | A | | 1/1989 | Nitzberg et al. | 137/68.1 |
| 4,819,832 | A | | 4/1989 | Lawson | 222/153 |
| 5,160,071 | A | | 11/1992 | Wright | 222/383 |
| 5,507,534 | A | | 4/1996 | Reifenberger et al. | 285/132 |
| 5,622,056 | A | | 4/1997 | Utter | 62/121 |
| 5,667,146 | A | * | 9/1997 | Pimentel et al. | 239/587.1 |
| 5,722,830 | A | * | 3/1998 | Brandhorst et al. | 433/90 |
| 5,921,232 | A | * | 7/1999 | Yokoi et al. | 128/200.14 |

* cited by examiner

*Primary Examiner*—Henry C. Yuen
*Assistant Examiner*—Davis Hwu
(74) *Attorney, Agent, or Firm*—The Maxham Firm

(57) ABSTRACT

A liquid dispensing device generally comprising an improved nozzle that is adaptable, connectable or threadable onto a standard trigger spray head. The improved nozzle is also swivelable or rotatable and directional to spray in any direction, up or down, left or right, or any variation thereof. It also has a cap that can be turned to produce a stream or spray or any variation thereof. The nozzle may be manufactured either as an attachment to an existing trigger spray unit or as a pre-manufactured assembly.

30 Claims, 2 Drawing Sheets

360° ROTATIONAL DIRECTIONAL NOZZLE FOR TRIGGER SPRAYERS

BACKGROUND OF THE INVENTION

1. Field of the Invention

The present invention relates generally to liquid dispensing devices and nozzles, and more particularly to a trigger type sprayer nozzle which is improved and adapted to spray in all directions.

2. Discussion of the Related Art

Generally, a trigger dispenser of the type involved here is a relatively low cost pump device which is held in the hand and which has a trigger operable by squeezing or pulling the fingers of the hand to pump liquid from a container and through a nozzle at the front of the dispenser.

Such dispensers may have a variety of features that have become common and well known in the industry. For example, the dispenser may be a dedicated sprayer that produces a defined spray pattern for the liquid as it is dispensed from the nozzle. It is also known to provide adjustable spray patterns so that with a single dispenser the user may select any one of several emission patterns ranging from a stream to a fine mist.

Some known trigger dispensers also include a way to seal the dispenser to prevent liquid from leaking from the nozzle orifice during shipment or non-use. A variety of sealing arrangements are known. It is also well known to provide trigger dispensers with a means to produce foaming of the liquid as it is dispensed from the nozzle orifice. Such dispensers are generally referred to in the industry as "foamers." Various types of foamers are well known to those skilled in the art.

Many substances are currently sold and marketed in containers with trigger sprayers. Examples of such substances include carpet cleaners, spot removers, cleaning products, weed control and pest control products, and materials for other general spraying uses. Typically, such items comprise a bottle that includes a spray head attached thereto. The spray head includes a manual pump that is actuated by the hand of a user to dispense the particular liquid product in a spray or stream to a desired surface location or in a desired direction.

The fluid connection between the spray head and the bottle containing the liquid is usually facilitated by a feed tube that extends downwardly from the spray head and into the liquid. The feed tube is generally sized so as to extend to a location adjacent the bottom surface of the bottle so that the entire contents of the bottle may be dispersed via the spray head. In operation, the actuation of the manual pump by the user creates a suction in the feed tube thereby drawing liquid therethrough for subsequent dispersion via the spray head.

Such containers possess certain inherent deficiencies that detract from their overall utility. Foremost is the requirement that such spray heads be generally horizontally oriented in order to function properly. In this respect, since the feed tube extends downwardly into the liquid within the bottle, tilting the bottle can result in drawing air rather than liquid into the feed tube, thereby causing the unit to loose function. In addition, many of the known spray heads have a built-in check valve. This check valve usually consists of a ball used to check or stop the fluid from returning down the feed tube. However, when the spray head is tilted the check valve ball can simply roll out of position and the unit will fail to draw liquid. Thus, current spray containers must be generally horizontally stabilized and numerous hand pumping actions are needed to refill the feed tube or to reposition the check valve. This causes frustration and improper discharging of liquid.

According to current construction, trigger sprayers are generally inoperable when used to apply a spray or stream of liquid in any direction other than in a generally horizontal direction. This particular deficiency becomes more apparent as the liquid level in the bottle decreases. The deficiencies of these trigger sprayers are very apparent when the user attempts to direct the spray in an other than horizontal direction.

This inability to apply a spray or stream creates significant difficulties when using such containers in specific applications such as spraying up under the leaves of plants, spraying pesticides up under cabinets, cleaning any horizontal surface such as ceilings, hoods, light fixtures or reaching under cars, animals, among others.

In addition, many applications require spraying in a downward direction such as spotting weeds, cleaning carpets, upholstery, floors or countertops, for example. One attempt to provide downward application of a spray is seen in U.S. Pat. No. 5,160,071 to Wright. It describes a spray bottle with a nozzle pointing in a downward direction. However, it is clear that this spray bottle is not suitable for spraying in any other direction. Many other applications require spraying left or right to some minor or major degrees of angle to reach the particular task at hand. Examples are reaching in ovens to spray all sides, or spraying all sides of a shower.

Furthermore, current trigger sprayers present a problem of reaching these particular spray applications by attempting to turn the user's hand in awkward positions. To hold a heavy liquid spray bottle vertically to spray in different directions can be awkward, and the unit may be inoperable in some position the user finds to be necessary.

Accordingly, there has not previously been available a nozzle connected to a trigger sprayer that is rotatable and directional to enable the user to spray in any direction without tilting the bottle. There is no known nozzle designed to swivel or rotate 360 degrees, creating the ability to aim the discharge pattern in any direction the operator chooses.

SUMMARY OF THE INVENTION

The present invention provides a sprayer nozzle assembly for dispensing fluid in any desired direction. It includes a rotatable conduit having an inlet end, a discharge end and a fluid passage, where an axis extending through the inlet end is at an angle with respect to an axis extending through the discharge end. It also includes a connection means to a fitting on a bottle or container of fluid to be sprayed. The connection means couples the rotatable conduit to the fitting in a sealed relation. Fluid can be dispensed in any desired direction by rotating the rotatable conduit while the container remains level.

The angle between the axis extending through the inlet end and the axis extending through the discharge end of the conduit is in the range of about 1 to 90 degrees with respect to one another. In a preferred embodiment, this angle is at about 60 degrees.

An alternative embodiment of a spray nozzle according to the invention includes a rotatable conduit having an inlet end, a discharge end and a fluid passage, where the inlet end and the discharge end are connected by a ball and socket joint. The ball member and the socket member have a central fluid passage. The nozzle assembly also includes a connection means to a fitting on a fluid container. The connection means connects the rotatable conduit to the fitting in a sealed relation. Fluid can be dispensed in any desired direction by rotating the rotatable conduit and moving the ball and socket joint while the container remains level.

In preferred embodiments the nozzle has a spray cap on the discharge end of the rotatable conduit and it is adjustable thereon to provide infinite adjustment of spray pattern.

Trigger sprayers attached to bottles which include the nozzle assembly of this invention are able to spray in up, down, left, right, or any directional variation thereof, without tilting the bottle and will not loose function when directed in such manner. The nozzle assembly greatly improves the ability to use trigger sprayers for many different uses including, but not limited to, carpet sprays, lawn and garden uses, cleaning products, industrial uses, health and beauty, and pet care, among others.

BRIEF DESCRIPTION OF THE DRAWING

The above and other objects and advantages of the present invention will become apparent from the following detailed description, when read in conjunction with the accompanying drawing, wherein.

DETAILED DESCRIPTION OF THE PREFERRED EMBODIMENTS

The nozzle assembly of this invention provides a dispensing nozzle that is rotatable and directional or swivelable to enable the user to spray in any direction without tilting the bottle. The nozzle is designed to swivel or rotate 360 degrees, creating the ability to aim the discharge pattern in any direction the operator chooses. In addition, the spray control cap on the nozzle can be adjusted to produce a stream or a spray or any variation thereof.

Figure 2:
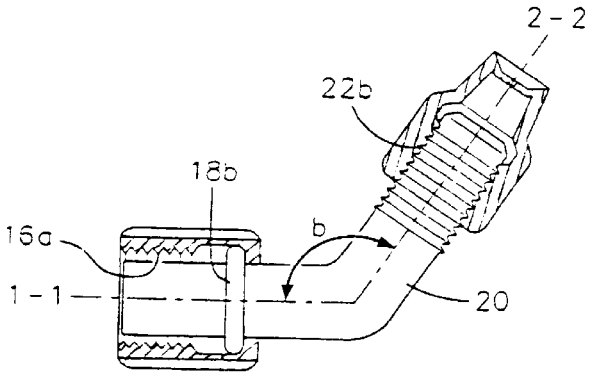
FIG. 2 is a side view illustrating the nozzle assembly shown in FIG. 1.

In a preferred embodiment, longitudinal axes extending through the inlet end and the discharge end of the conduit are at approximately 60 degrees with respect to one another. However it is contemplated herein that this angle can be any practical angle between 1 and 90 degrees. These axes are shown in FIG. 2, where axis 1—1 extends longitudinally through the inlet end and axis 2—2 extends longitudinally through the discharge end. Angle b is the angle between axis 1—1 and axis 2—2.

Figure 1:
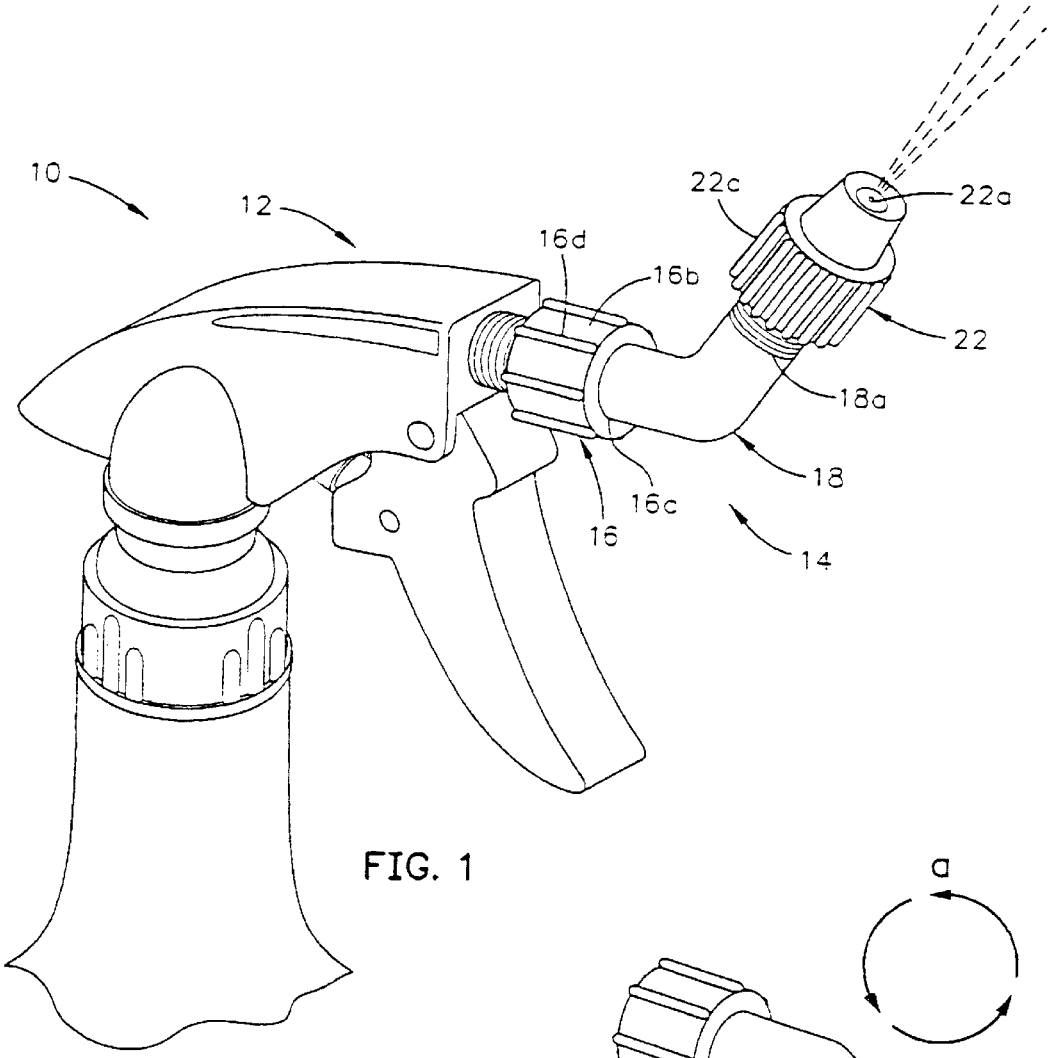
FIG. 1 is a perspective view of a rotational directional nozzle dispensing device attached to a trigger sprayer, the nozzle dispenser being constructed in accordance with a preferred embodiment of the present invention.

FIG. 1 illustrates nozzle assembly 14 threadably connected to trigger sprayer 10 constructed in accordance with the preferred embodiment of the present invention. The trigger sprayer is shown coupled to a portion of the top of the bottle or container which holds the material to be sprayed. The nozzle assembly generally comprises connector 16 and rotatable conduit 18 with discharge end 20 configured to receive spray control cap 22.

Connector 16 preferably has receivable female threads 16*a* (FIG. 2). Connector outer wall 16*b* may be knurled at a point 16*d* therealong so it can be readily grasped and rotated. Additionally the connector has a receiving opening 16*c* to mate with the rotatable conduit 18. The rotatable conduit preferably has male threads 18*a* to receive spray control cap 22 on its discharge end 20. Cap 22 can be adjusted to provide a stream or spray, or any variation thereof, as desired. In addition, the spray control cap can be adjusted to provide a seal so that leakage of fluid is prevented during storage.

Rotatable conduit 18 also has flange 18*b* to hold the rotatable conduit in place within connector 16. The rotatable conduit is slidably inserted up to its flange in the receiving front portion of the body of trigger sprayer 10 to communicate with a fluid passage (not shown in drawing) in the trigger sprayer.

Connector 16 can be manually tightened to hold the rotatable conduit 18 in position. Spray control cap 22 has outlet orifice 22*a* and female threadable receiver 22*b*. Also the spray control cap has outer wall 22*c* that may be knurled or designed for ease of handling.

Figure 3:
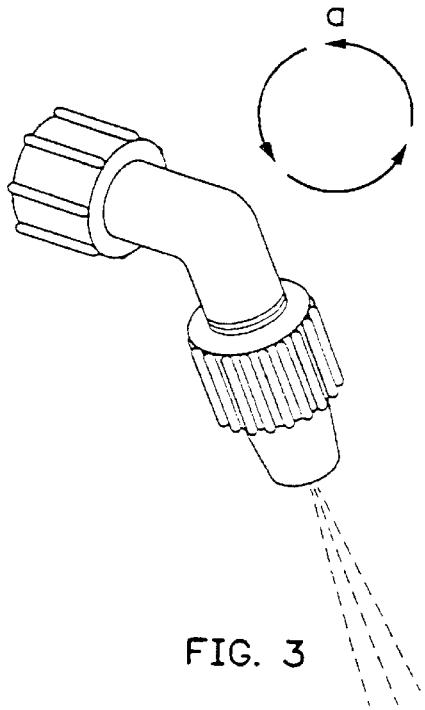
FIG. 3 is a perspective view of a rotational directional nozzle dispensing device constructed in accordance with a preferred embodiment of the present invention showing rotation "a" of the conduit.

The rotatable conduit is thereby mounted with the connector to the trigger sprayer allowing rotatable conduit 18 to freely rotate. This provides the ability to aim or direct the spray without changing the position or without tilting the fluid container. This is advantageous because liquid can be conveniently delivered to almost any location while keeping the fluid container horizontal. This ensures a continuous and reliable flow. Rotatable conduit flange 18*b* mounts comfortably into the fluid passage (not shown in drawing) of trigger sprayer 10 and the flange can be tightened down with connector 16 in a permanent position or connector 16 may be slightly loosened to create the ability to easily rotate the conduit through 360 degrees, thereby creating directional moveability of the dispensed fluid. This rotation is shown, for example, in FIG. 3 by arrow "a." It will be recognized that spray control cap 22 may be selectively adjusted to apply a stream or spray as is conventional in the art.

Figure 4:
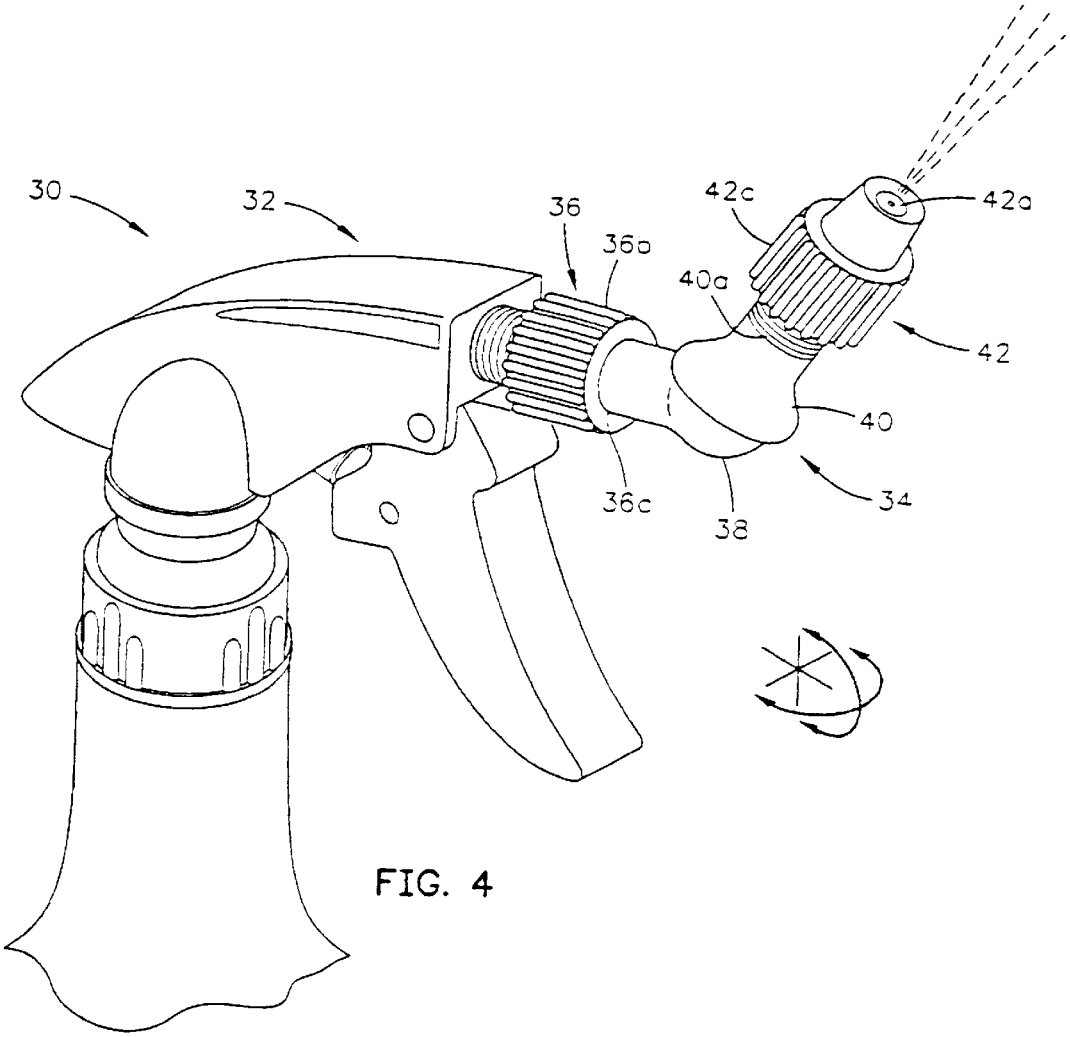
FIG. 4 is a perspective view illustrating a rotational directional nozzle dispensing device attached to a trigger sprayer, the nozzle dispenser being constructed in accordance with a second embodiment of the present invention.

Referring now to FIG. 4, there is shown a nozzle assembly 34 constructed in accordance with a second embodiment of the present invention. This nozzle assembly generally comprises a connector and rotational ball joint mount connectable member 36, rotatable ball joint 38 which mates with receiving socket member 40 having discharge end 44 that can receive spray control cap 42.

Figure 5:
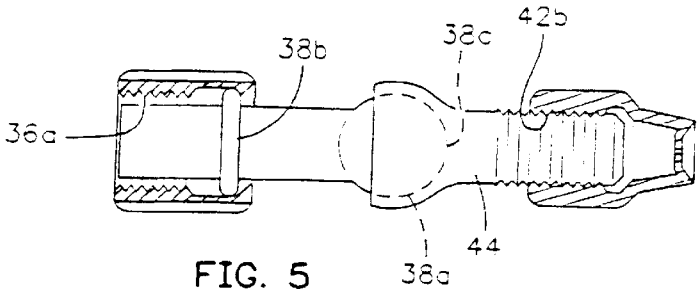
FIG. 5 is a side view illustrating the nozzle shown in FIG. 4.

Connector 36 preferably has female threads 36*a* (FIG. 5). Connector outer wall 36*b* may be knurled as shown so it can be readily grasped and rotated to direct the pattern of fluid dispensed. Additionally, the connector has receiving opening 36*c* to mate with rotatable ball joint 38, which is formed with flange 38*b*. This flange functions in the same manner as flange 18*b* in FIG. 2.

Rotatable ball joint 38 has rotatable ball element 38*a* at one end that is received within socket 38*c* of receiving socket member 40. The receiving socket member has male threads 40*a* to receive spray control cap 42 on discharge end 44 of socket member 40. The spray control cap has outlet orifice 42*a* and female threaded receiver 42*b*. Examples of alternative ball joints are provided in U.S. Pat. No. 4,800,913 to Nitzberg et al. and U.S. Pat. No. 5,507,534 to Reifenberger et al. Other types of ball joints are contemplated herein, as are well known to those skilled in the art.

Spray control cap 42 has an outer wall 42*c* that may be knurled or otherwise designed for ease of handling. It is understood that the spray control cap may be selectively adjusted to apply a stream or spray as is conventional in the art. It is also understood that the spray cap may only produce a stream or may only produce a spray or any variation in between. Additionally, in a preferred embodiment, the spray cap can be adjusted so that the container is sealed to prevent leakage during storage.

The various forms of the invention described provide simply constructed and economical directional structures to provide a rotational and directional spray nozzle with the spray type being changeable or adjustable. Thus, the user of the present invention is able to spray in any direction desired without tilting the bottle. This provides greater functionality by ensuring a continuous and reliable flow of fluid since the bottle can remain level throughout.

It is understood by those skilled in the art that the rotatable conduit can have other shapes, such as elbows or angles of varying forms of degree, for example. The rotatable conduit may be manufactured to be in a permanent position of up or down or left or right, etc. The conduit may be manufactured as one piece with the connector. The housing may be constructed of a ball and receiving socket or a plurality of sockets and balls, such as described in U.S. Pat. No. 4,035,004 to Hengersbach. The connector is not limited to having threads but may be connected or adapted by other interconnection methods, such as quick-connect couplers, as are well known. Accordingly, it is contemplated herein that the connector comprises any suitable form of connection that allows a tight fit without leaking. A threaded connector is only one example.

The nozzle assembly may be manufactured in many different types of plastic or may be produced in other materials. It may be made of molded plastic at a relatively low cost. The nozzle assembly may be manufactured of bendable or flexible material to bend the rotatable conduit to direct the spray. In a preferred embodiment, the nozzle assembly can be bent or flexed and retained in that position. In addition, the spray control cap may be adapted to produce different types of spray or stream. The nozzle assembly may be manufactured either as an attachment to an existing trigger spray unit or as a pre-manufactured assembly.

It is also understood to those skilled in the art that there are numerous manufacturers of trigger sprayers and in the preferred embodiment the nozzle assembly is threadably connected and the nozzle threads or connection may be designed to fit or adapt to many different styles of trigger sprayers.

While the present invention has been illustrated and described by means of a specific embodiment, it is to be understood that numerous changes and modifications can be made herein without departing from the spirit and scope of the invention. Accordingly, the invention is limited only by the following claims.

What is claimed is:

1. A sprayer nozzle assembly for dispensing a fluid in any desired direction from a fluid container, the container having a dispenser apparatus mounted thereto, the nozzle assembly comprising:

a rotatable conduit positioned downstream in a fluid flow relation to said dispenser apparatus, said rotatable conduit having an inlet end, a discharge end and a fluid passage, wherein an axis extending though said inlet end is at an angle with respect to an axis extending through said discharge end; and a connector configured to connect said rotatable conduit to said dispenser apparatus in fluid flow relation;

wherein the fluid can be dispensed in any desired direction by rotating said rotatable conduit with respect to the container.

2. The nozzle assembly of claim 1, and further comprising a spray control cap on the discharge end of said conduit, said spray control cap being adjustable thereon to provide continuous adjustment of discharge pattern of the fluid being dispensed.

3. The nozzle assembly of claim 2, wherein said spray control cap is knurled.

4. The nozzle assembly of claim 3, wherein said spray control cap further comprises a seal.

5. The nozzle assembly of claim 1, wherein the axis extending through said inlet end and the axis extending through said discharge end of said conduit are at about 60 degrees with respect to one another.

6. The nozzle assembly of claim 1, wherein the axis extending through said inlet end and the axis extending through said discharge end of said conduit are in the range of about 1 to 90 degrees with respect to one another.

7. The nozzle assembly of claim 1, wherein said conduit is flexible.

8. The nozzle assembly of claim 7, wherein said conduit can be bent into any position and retained in that position.

9. The nozzle assembly of claim 1, wherein said connector has connection means selected from the group consisting of threads, quick-connect couplers and snap connectors.

10. The nozzle assembly of claim 9, wherein said connection means has an opening adapted for sealing said conduit to said dispenser apparatus.

11. The nozzle assembly of claim 10, wherein said connection means is rotatable and is knurled.

12. A sprayer nozzle assembly for dispensing a fluid in any desired direction from a fluid container having a trigger dispenser, the nozzle assembly comprising;

a rotatable conduit positioned downstream in a fluid flow relation to said dispenser apparatus, said rotatable conduit having an inlet end, a discharge end and a fluid passage, wherein said inlet end and said discharge end are connected by a ball and socket joint, wherein said ball and socket joint includes a ball member and a socket member having complementary concentric spherical contact surfaces, respectively, wherein said ball member and said socket member have a central fluid passage; and a connector configured to connect said rotatable conduit to said trigger dispenser in fluid flow relation;

wherein the fluid can be dispensed in any desired direction by rotating said rotatable conduit and moving said ball and socket joint.

13. The nozzle assembly of claim 12, and further comprising a spray control cap on said discharge end of said conduit, said cap being adjustable thereon to provide continuous adjustment of a discharge pattern of the fluid being dispensed.

14. The nozzle assembly of claim 13, wherein said spray control cap is knurled.

15. The nozzle assembly of claim 14, wherein said spray control cap further comprises a seal.

16. The nozzle assembly of claim 12, wherein the axis extending through said inlet end and the axis extending through said discharge end of said conduit are at about 60 degrees with respect to one another.

17. The nozzle assembly of claim 12, wherein the axis extending through said inlet end and the axis extending through said discharge end of said conduit are in the range of about 1 to 90 degrees with respect to one another.

18. The nozzle assembly of claim 12, wherein said connector has connection means selected from the group consisting of threads, quick-connect couplers and snap connectors.

19. The nozzle assembly of claim 18, wherein said connection means has an opening adapted for sealing said conduit to said trigger dispenser.

20. The nozzle assembly of claim 19, wherein said connection means is rotatable and is knurled.

21. A fluid dispensing device for dispensing a fluid in any desired direction from a fluid container, the fluid dispensing device comprising:

a dispenser apparatus in fluid connection with the fluid in the container; and a nozzle assembly positioned downstream in fluid flow relation to said dispenser apparatus, said nozzle assembly comprising:

a rotatable conduit having an inlet end, a discharge end and a fluid passage, wherein an axis extending through said inlet end is at an angle with respect to an axis extending through said discharge end; and a connector configured to connect said rotatable conduit to said dispenser apparatus in a fluid flow relation;

wherein the fluid can be dispensed in any desired direction by rotating said rotatable conduit with respect to the container.

22. The device of claim 21, and further comprising a spray control cap on said discharge end of said conduit, said spray control cap being adjustable thereon to provide continuous adjustment of a discharge pattern of the fluid being dispensed.

23. The device of claim 22, wherein said spray control cap is knurled.

24. The device of claim 23, wherein said spray control cap further comprises a seal.

25. The device of claim 21, wherein the axis extending through said inlet end and the axis extending through said discharge end of said conduit are at about 60 degrees with respect to one another.

26. The device of claim 21, wherein the axis extending through said inlet end and the axis extending through said discharge end of said conduit are in the range of about 1 to 90 degrees with respect to one another.

27. The device of claim 21, wherein said conduit is flexible.

28. The device of claim 27, wherein said conduit can be bent into any position and retained in that position.

29. The device of claim 21, wherein said connector has connection means selected from the group consisting of threads, quick-connect couplers and snap connectors.

30. The device of claim 29, wherein said connection means is rotatable and is knurled.

* * * * *